US009732587B2

(12) United States Patent
Patwa et al.

(10) Patent No.: US 9,732,587 B2
(45) Date of Patent: Aug. 15, 2017

(54) INTERVAL CONTROL VALVE WITH VARIED RADIAL SPACINGS

(71) Applicant: HALLIBURTON ENERGY SERVICES, INC., Houston, TX (US)

(72) Inventors: Ruchir S. Patwa, Tomball, TX (US); Pranay Asthana, Spring, TX (US); Joel D. Shaw, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 348 days.

(21) Appl. No.: 14/377,945

(22) PCT Filed: Jan. 22, 2013

(86) PCT No.: PCT/US2013/022517

§ 371 (c)(1),
(2) Date: Aug. 11, 2014

(87) PCT Pub. No.: WO2014/116202

PCT Pub. Date: Jul. 31, 2014

(65) Prior Publication Data

US 2015/0013989 A1 Jan. 15, 2015

(51) Int. Cl.

| | |
|---|---|
| ***E21B 34/14*** | (2006.01) |
| ***E21B 4/12*** | (2006.01) |
| ***E21B 34/08*** | (2006.01) |
| ***E21B 43/12*** | (2006.01) |

(52) U.S. Cl.
CPC ..... *E21B 34/08* (2013.01); *E21B 34/14* (2013.01); *E21B 43/12* (2013.01)

(58) Field of Classification Search
CPC ..... E21B 34/14; E21B 43/12; E21B 2034/007
See application file for complete search history.

(56) References Cited

U.S. PATENT DOCUMENTS

| | | | | |
|---|---|---|---|---|
| 5,957,208 | A | 9/1999 | Schnatzmeyer | |
| 6,276,458 | B1 * | 8/2001 | Malone | E21B 21/10 166/240 |
| 6,715,558 | B2 | 4/2004 | Williamson | |

(Continued)

FOREIGN PATENT DOCUMENTS

| | | |
|---|---|---|
| EP | 1234100 B1 | 2/2005 |
| GB | 2388618 A | 11/2003 |

(Continued)

OTHER PUBLICATIONS

International Search Report with Written Opinion issued Nov. 13, 2013 for PCT Patent Application No. PCT/US2013/022517, 16 pages.

*Primary Examiner* — Giovanna C Wright
(74) *Attorney, Agent, or Firm* — Locke Lord LLP

(57) ABSTRACT

A flow control device for use with a subterranean well, can include inner and outer flow trim sleeves. A radial spacing between the inner and outer flow trim sleeves increases in a direction of flow through the radial spacing. A method of regulating flow between an interior and an exterior of a tubular string in a well can include displacing at least one of inner and outer flow trim sleeves in a direction, a radial spacing between the inner and outer trim sleeves increasing in the direction. Another flow control device can include inner and outer flow trim sleeves, and a flow area through the radial spacing increases in a direction of flow through the radial spacing.

24 Claims, 5 Drawing Sheets

(56) References Cited

U.S. PATENT DOCUMENTS

| | | | |
|---|---|---|---|
| 7,451,825 | B2 | 11/2008 | Jonas |
| 7,455,115 | B2 | 11/2008 | Loretz et al. |
| 7,575,058 | B2 | 8/2009 | Franco et al. |
| 7,712,540 | B2 | 5/2010 | Loretz et al. |
| 2003/0159832 | A1 | 8/2003 | Williamson |
| 2003/0173116 | A1 | 9/2003 | Wells et al. |
| 2007/0044956 | A1 | 3/2007 | Jonas |
| 2009/0014185 | A1 | 1/2009 | Franco et al. |
| 2009/0020292 | A1 | 1/2009 | Loretz et al. |
| 2011/0240284 | A1 | 10/2011 | Hamid et al. |
| 2012/0006563 | A1 | 1/2012 | Patel et al. |
| 2012/0067593 | A1 | 3/2012 | Powell et al. |

FOREIGN PATENT DOCUMENTS

| | | | |
|---|---|---|---|
| WO | 2009009281 | A2 | 1/2009 |
| WO | 2009009281 | A3 | 1/2009 |

* cited by examiner

INTERVAL CONTROL VALVE WITH VARIED RADIAL SPACINGS

CROSS-REFERENCE TO RELATED APPLICATION

This application is a national stage under 35 USC 371 of International Application No. PCT/US13/22517, filed on 22 Jan. 2013. The entire disclosure of this prior application is incorporated herein by this reference.

TECHNICAL FIELD

This disclosure relates generally to equipment utilized and operations performed in conjunction with a subterranean well and, in one example described below, more particularly provides an interval control valve with varied radial spacings.

BACKGROUND

Interval control valves can be used to control flow between tubular strings and various intervals penetrated by a wellbore. It will be appreciated that advancements are continually needed in the art of constructing and operating interval control valves and other types of flow control devices in subterranean wells.

DETAILED DESCRIPTION

Figure 1:
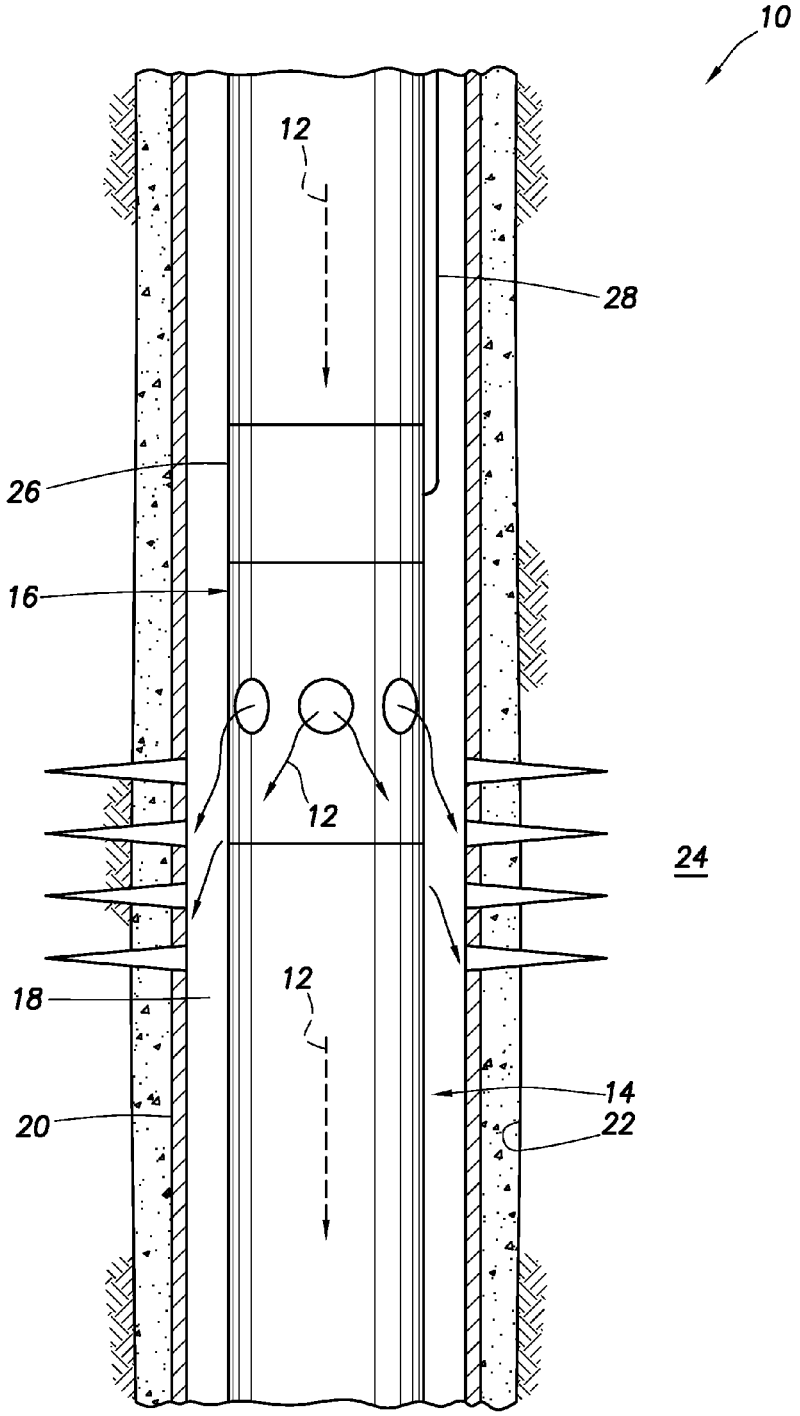
FIG. 1 is a representative partially cross-sectional view of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a fluid 12 is flowed through a generally tubular string 14. At sections or intervals along the tubular string 14, one or more interval flow control device(s) 16 controls flow between an interior and an exterior of the tubular string. Only one flow control device 16 is depicted in FIG. 1, but in other examples, any number of flow control devices could be used.

The exterior of the flow control device 16 is exposed to an annulus 18 formed radially between the tubular string 14 and a casing 20 cemented in a wellbore 22. The annulus 18 at this interval is in fluid communication with a formation zone 24. Thus, the flow control device 16 regulates flow between the interior of the tubular string 14 and an associated formation zone 24.

The flow control device 16 in this example includes an actuator 26, which is actuated via one or more lines 28 extending to a remote location (such as the earth's surface or another location in the well). The actuator 26 may be of any type, such as, electrical, hydraulic, optical, etc. The lines 28 may be of any type, such as, electrical, hydraulic or optical lines.

In other examples, the actuator 26 may not be remotely actuated or controlled via the lines 28. For example, various forms of telemetry (such as, acoustic, electromagnetic, pressure pulse, etc.) could be used for controlling operation of the actuator 26. The actuator 26 could be supplied with electrical power via batteries. Thus, the scope of this disclosure is not limited to use of any particular type of actuator.

It is desired in the FIG. 1 example to variably restrict flow of the fluid 12 from the interior of the tubular string 14 to the zone 24. In doing so, it is also desired to reduce or eliminate erosion of the casing 20 exterior to the flow control device 16, and to provide for long term reliable performance of the flow control device.

These objectives, and others, are accomplished with use of a uniquely configured flow trim in the flow control device 16. This flow trim is also configured to reduce plugging by particulate matter in the fluid 12, and if such particulate matter should begin to block flow, the flow trim is configured to be self-cleaning.

Figure 2:
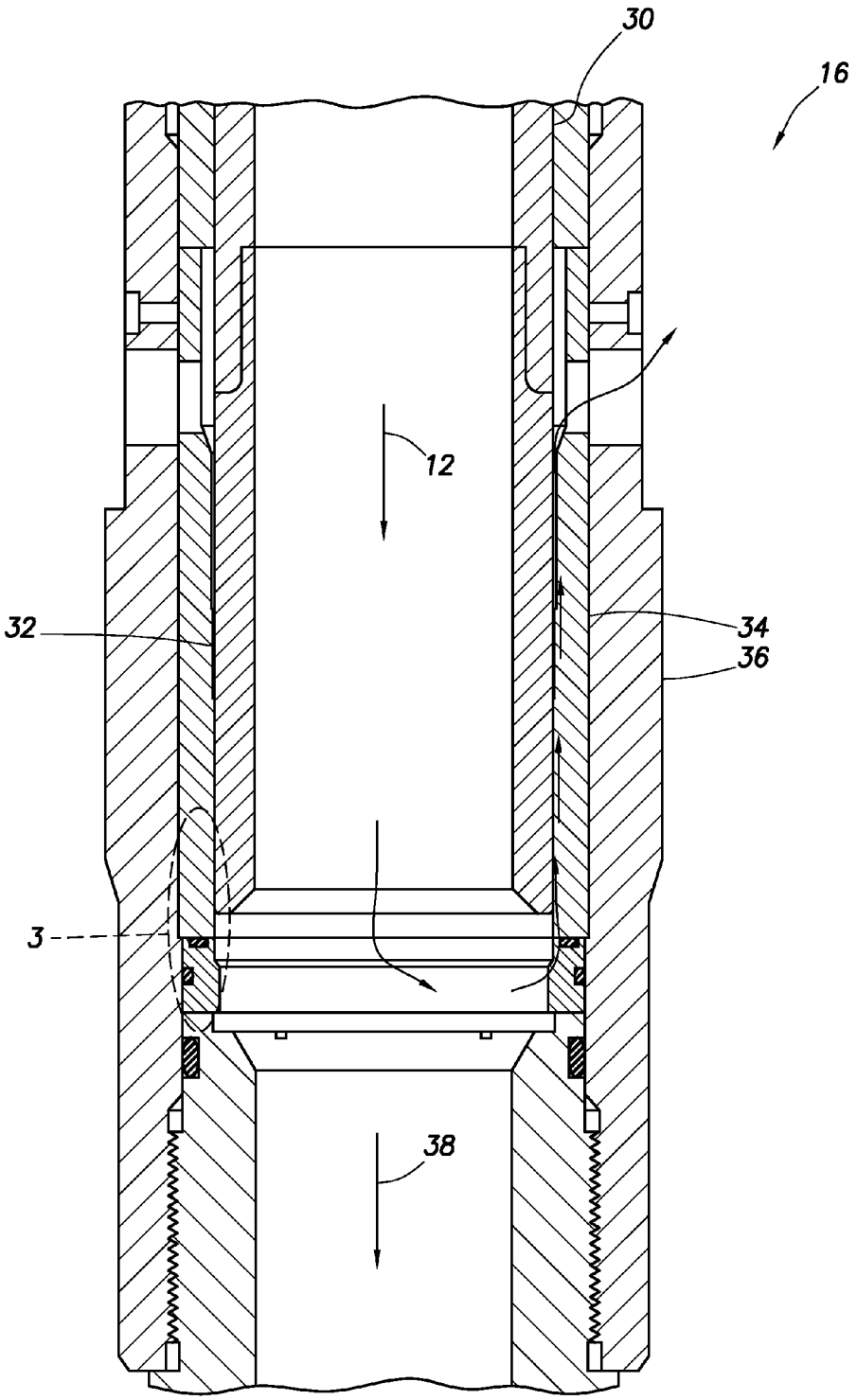
FIG. 2 is an enlarged scale representative cross-sectional view of an interval flow control device which may be used in the system and method of FIG. 1, and which can embody the principles of this disclosure.

Referring additionally now to FIG. 2, a representative cross-sectional view of a flow trim portion of the flow control device 16 is representatively illustrated. In this example, a mandrel 30 of the actuator 26 is connected to an inner flow trim sleeve 32. The inner flow trim sleeve 32 is displaced axially relative to an outer flow trim sleeve 34 secured in a housing 36, to thereby vary a resistance to flow of the fluid 12 between the interior and the exterior of the flow control device 16.

Note that the fluid 12 has to reverse direction, in order to flow through an annular space between the inner and outer flow trim sleeves 32, 34. This reversal of direction is beneficial, in that it reduces a quantity of particulate matter 38 in the fluid 12 that will try to enter the annular space between the inner and outer flow trim sleeves 32, 34, thereby reducing a likelihood of plugging. That is, inertia, or a momentum of the particulate matter 38, will act to discourage reversal of direction of the particulate matter, in order for the particulate matter to flow upward between the inner and outer flow trim sleeves 32, 34.

Figure 3:
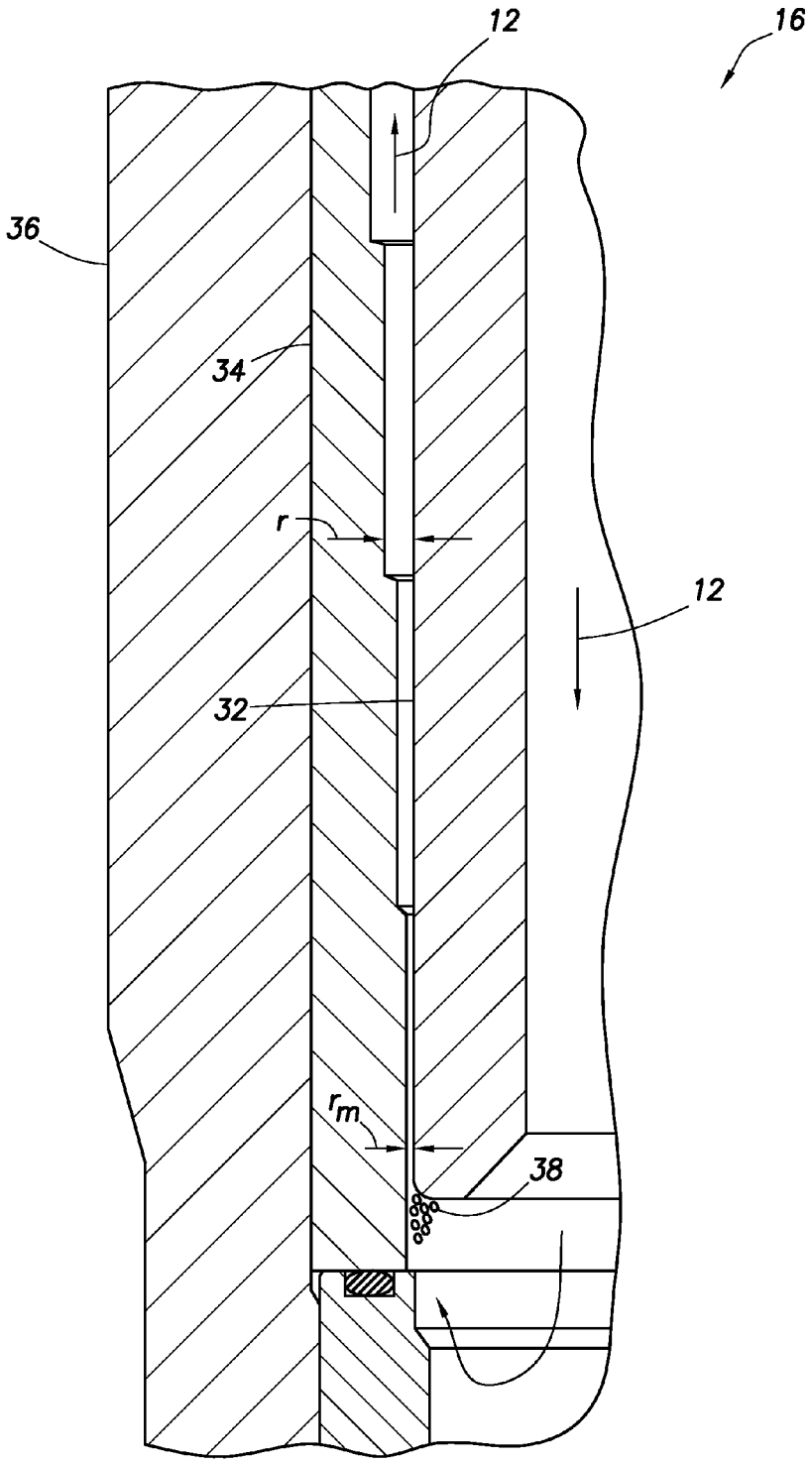
FIG. 3 is a further enlarged scale representative cross-sectional view of a flow trim portion of the interval flow control device.

Referring additionally now to FIG. 3, an enlarged scale cross-sectional view of detail 3 in FIG. 2 is representatively illustrated. In this view, it may be seen that a radial spacing r between the inner and outer flow trim sleeves 32, 34 varies in a longitudinal direction.

In this example, an interior surface of the outer flow trim sleeve 34 is incrementally stepped. As the inner flow trim sleeve 32 is displaced upward by the actuator 26, a minimal radial spacing $r_m$ between the inner and outer flow trim sleeves 32, 34 will increase, thereby permitting increased flow through the radial spacing between the sleeves.

Note that any particulate matter 38 that attempts to flow upward with the fluid 12 between the inner and outer flow trim sleeves 32, 34 will accumulate at an entrance to the minimal radial spacing $r_m$ between the sleeves, in this example. This prevents, or at least reduces a likelihood that, other portions of the flow trim will become plugged with the particulate matter 38.

In the FIG. 3 example, the actuator 26 can displace the inner flow trim sleeve 32 upward to thereby increase the minimal radial spacing $r_m$ between the sleeves 32, 34. This increased radial spacing r results in an increased annular flow area between the sleeves 32, 34, thereby increasing a rate of flow between the interior and exterior of the device 16.

In other examples, the inner sleeve 32 could be displaced downward or in other directions to increase flow area, the outer sleeve 34 could be displaced instead of, or in addition to, the inner sleeve 32, etc. Thus, it should be clearly understood that the scope of this disclosure is not limited to the details of the device 16 and its sleeves 32, 34 as described herein and depicted in the drawings. Instead, many variations can result from applying the principles of this disclosure in practice.

Figure 4:
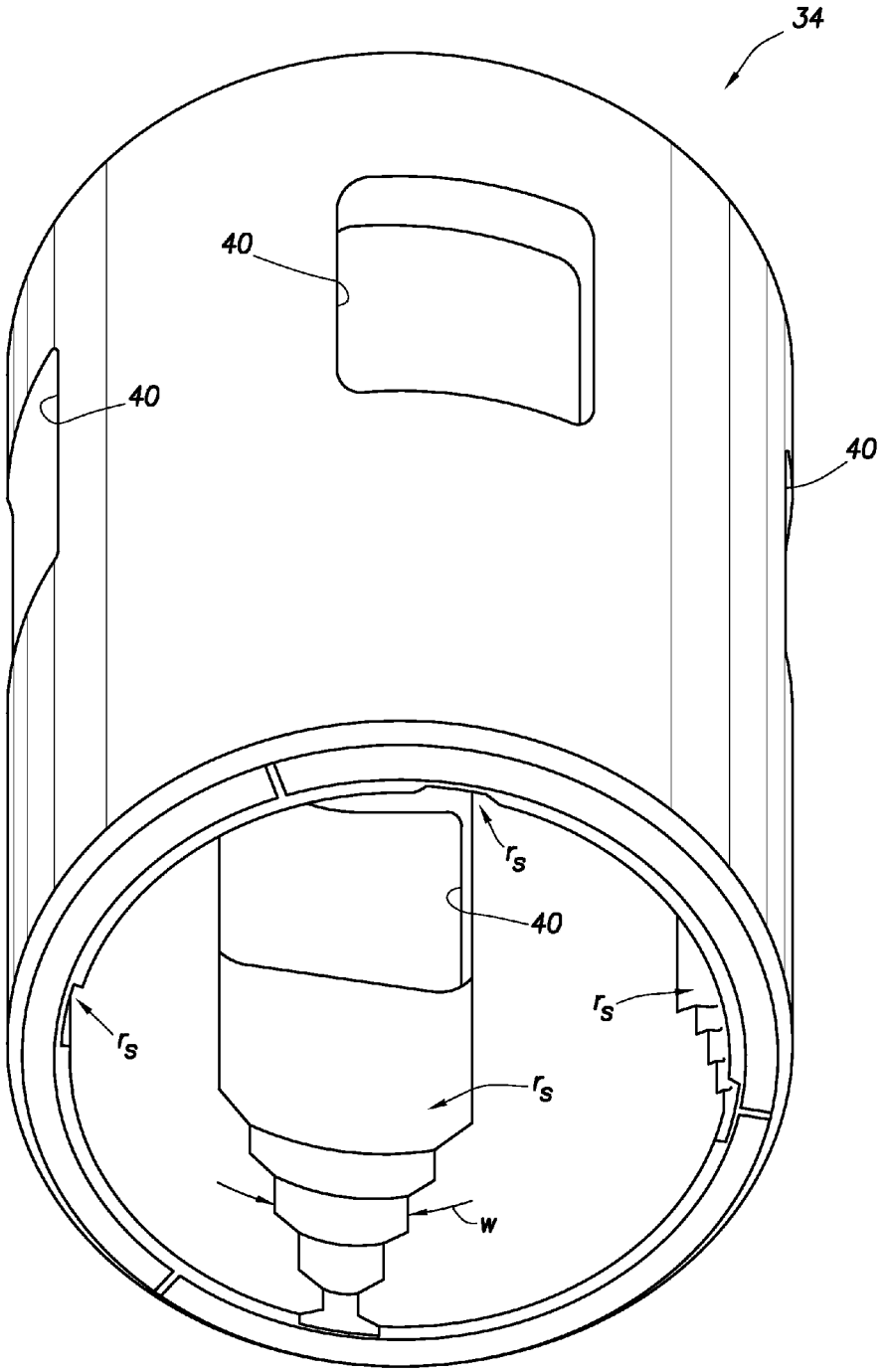
FIG. 4 is a representative perspective view of an outer flow trim sleeve of the interval flow control device.

Referring additionally now to FIG. 4, a perspective view of the outer sleeve 34, apart from the remainder of the device 16, is representatively illustrated. In this view, it may be seen that an interior surface of the sleeve 34 is incrementally stepped to provide the variations in radial spacings r described above. In other examples, the interior surface of the sleeve 34 could be tapered or otherwise formed to longitudinally vary the radial spacing r between the sleeves 32, 34.

Note that the radial spacings r are not circumferentially continuous. Instead, four sets $r_s$ of the radial spacings r are circumferentially spaced apart in the sleeve 34, with each set corresponding to an opening 40 formed radially through the sleeve. In this manner, the inner and outer sleeves 32, 34 can be closely fit, with minimal radial clearance between the sleeves in the areas between the sets $r_s$ of radial spacings r, thereby mitigating vibration in the sleeves in high flow rate applications.

In addition, a circumferential width w of the radial spacings r incrementally increases in the direction of flow between the sleeves 32, 34. In the FIG. 4 example, each incremental increase in the radial spacing r is provided with a respective increase in the circumferential width w of the radial spacing.

This increased width w further increases the annular flow area between the sleeves 32, 34 when the inner sleeve 32 is displaced upward. The increased flow area beneficially reduces flow velocity for a given flow rate, and this aids in reducing erosion of components (such as casing 20) external to the device 16.

Figure 5:
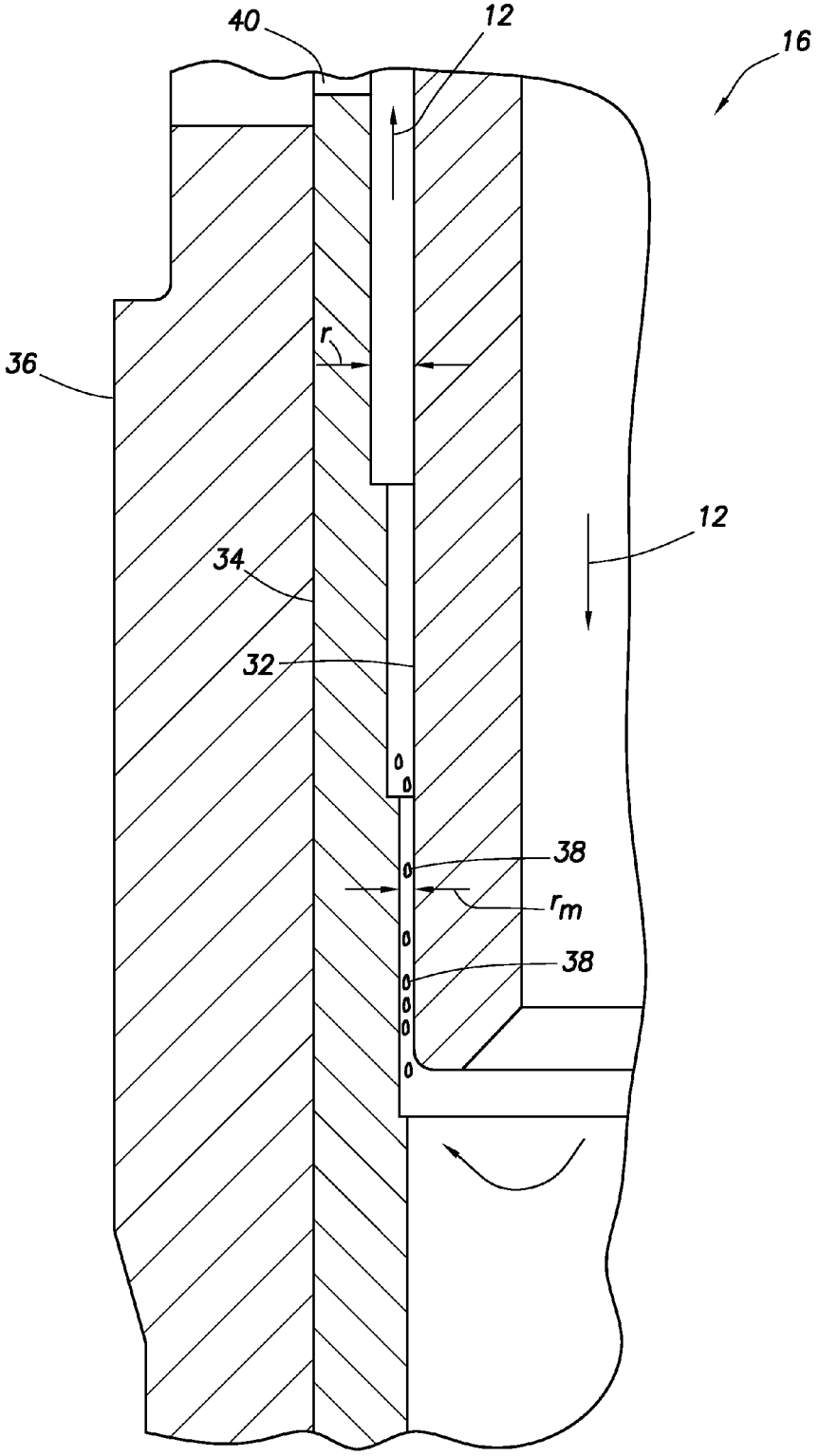
FIG. 5 is a representative cross-sectional view of the flow trim portion of the interval flow control device, with increased radial spacing between the outer flow trim sleeve and an inner flow trim sleeve.

Referring additionally now to FIG. 5, the self-cleaning feature of the device 16 is representatively illustrated. In the FIG. 5 illustration, the inner sleeve 32 has been displaced upward by the actuator 26, so that the minimal radial spacing $r_m$ between the sleeves 32, 34 is increased. The particulate matter 38 can now flow with the fluid 12 between the sleeves 32, 34 and eventually out of the device 16. Of course, the sleeve 32 can be displaced further upward to increase the minimal radial spacing $r_m$ between the sleeves 32, 34, if needed.

Although in the illustrated examples, the fluid 12 initially flows downward through the device 16, and reverses its direction of flow, in order to flow between the inner and outer flow trim sleeves 32, 34, it will be appreciated that these directions could be reversed in other examples. The fluid 12 could flow inward from an exterior to an interior of the flow control device 16 in other examples.

It may now be fully appreciated that the above disclosure provides significant advancements to the art of constructing and operating flow control devices in wells. In examples described above, the flow control device 16 can be used to variably regulate flow of the fluid 12, while mitigating erosion of the casing 20 and reducing a likelihood of plugging of the device.

A flow control device 16 for use with a subterranean well is described above. In one example, the flow control device 16 can include inner and outer flow trim sleeves 32, 34. A radial spacing r between the inner and outer flow trim sleeves 32, 34 increases in a direction of flow between the inner and outer trim sleeves.

The radial spacing r may increase in discrete increments, and/or may be stepped. The radial spacing r may not be circumferentially continuous between the inner and outer flow trim sleeves 32, 34. A width w of the radial spacing r may increase in the direction of flow.

The flow control device 16 can include an actuator 26 which produces relative displacement between the inner and outer flow trim sleeves 32, 34. The actuator 26 may displace one of the inner and outer flow trim sleeves 32, 34 in the flow direction.

A method of regulating flow between an interior and an exterior of a tubular string 14 in a well is also described above. In one example, the method can comprise: displacing at least one of inner and outer flow trim sleeves 32, 34 in a direction, a radial spacing r between the inner and outer trim sleeves 32, 34 increasing in the displacement direction.

A fluid 12 may reverse direction prior to flowing through the radial spacing r between the inner and outer trim sleeves 32, 34. The fluid 12 may flow in the displacement direction between the inner and outer trim sleeves 32, 34.

Another flow control device 16 example described above includes inner and outer flow trim sleeves 32, 34, and a flow area through a radial spacing r between the inner and outer flow trim sleeves increasing in a direction of flow through the radial spacing r.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper,"

"lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A flow control device for use with a subterranean well, the flow control device comprising:

an outer housing;

inner and outer flow trim sleeves disposed within the outer housing; and a radial spacing between the inner and outer flow trim sleeves, the radial spacing increasing in a direction of flow between the inner and outer trim sleeves, wherein the radial spacing is circumferentially discontinuous between the inner and outer flow trim sleeves.

2. The flow control device of claim 1, wherein the radial spacing increases in discrete increments.

3. The flow control device of claim 1, wherein the radial spacing is stepped.

4. The flow control device of claim 1, further comprising an actuator, and wherein the actuator produces relative displacement between the inner and outer flow trim sleeves.

5. The flow control device of claim 4, wherein the actuator displaces one of the inner and outer flow trim sleeves in the direction of flow.

6. The flow control device of claim 1, wherein a flow area through the radial spacing increases in the direction of flow.

7. The flow control device of claim 1, wherein a width of the radial spacing increases in the direction of flow.

8. The flow control device of claim 1, wherein the radial spacing comprises two or more sets of radial spacing circumferentially spaced apart in the outer flow trim sleeve.

9. The flow control device of claim 8, wherein each set of radial spacing corresponds to an opening formed radially through the outer flow trim sleeve.

10. The flow control device of claim 8, wherein each set of radial spacing is formed on an interior surface of the outer flow trim sleeve.

11. A method of regulating flow between an interior and an exterior of a tubular string in a well, the method comprising:

displacing relative to an outer housing at least one of inner and outer flow trim sleeves in a direction, wherein the inner and outer flow trim sleeves are disposed within the outer housing, wherein a radial spacing between the inner and outer trim sleeves increases in the direction of flow, and wherein the radial spacing is circumferentially discontinuous between the inner and outer flow trim sleeves.

12. The method of claim 11, wherein a fluid reverses direction prior to flowing through the radial spacing between the inner and outer trim sleeves.

13. The method of claim 11, wherein a fluid flows in the direction between the inner and outer trim sleeves.

14. The method of claim 11, wherein the radial spacing increases in discrete increments.

15. The method of claim 11, wherein an actuator produces relative displacement between the inner and outer flow trim sleeves.

16. The method of claim 15, wherein the actuator displaces one of the inner and outer flow trim sleeves in the direction.

17. The method of claim 11, wherein a flow area through the radial spacing increases in the direction.

18. The method of claim 11, wherein a width of the radial spacing increases in the direction.

19. A flow control device for use with a subterranean well, the flow control device comprising:

an outer housing; and inner and outer flow trim sleeves reciprocably disposed within the outer housing, wherein a flow area through a radial spacing between the inner and outer flow trim sleeves increases in a direction of flow through the radial spacing; and wherein the radial spacing is circumferentially discontinuous between the inner and outer flow trim sleeves.

20. The flow control device of claim 19, wherein the radial spacing between the inner and outer flow trim sleeves increases in the direction of flow.

21. The flow control device of claim 20, wherein the radial spacing increases in discrete increments.

22. The flow control device of claim 19, further comprising an actuator, and wherein the actuator produces relative displacement between the inner and outer flow trim sleeves.

23. The flow control device of claim 22, wherein the actuator displaces one of the inner and outer flow trim sleeves in the direction of flow.

24. The flow control device of claim 19, wherein a width of the radial spacing increases in the direction of flow.

* * * * *